US006778676B2

(12) United States Patent
Groth et al.

(10) Patent No.: US 6,778,676 B2
(45) Date of Patent: Aug. 17, 2004

(54) ACOUSTIC TRANSMISSION CONNECTION, HEADSET WITH ACOUSTIC TRANSMISSION CONNECTION, AND USES OF THE ACOUSTIC TRANSMISSION CONNECTION

(75) Inventors: Torben Groth, Allerød (DK); Peter Møller, Kokkedal (DK)

(73) Assignee: GN Netcom A/S (DK)

( * ) Notice: Subject to any disclaimer, the term of this patent is extended or adjusted under 35 U.S.C. 154(b) by 0 days.

(21) Appl. No.: 10/275,640

(22) PCT Filed: May 1, 2001

(86) PCT No.: PCT/DK01/00295

§ 371 (c)(1),
(2), (4) Date: May 12, 2003

(87) PCT Pub. No.: WO01/91511

PCT Pub. Date: Nov. 29, 2001

(65) Prior Publication Data

US 2003/0173145 A1 Sep. 18, 2003

(30) Foreign Application Priority Data

May 25, 2000 (DK) ..... 2000 00834

(51) Int. Cl.[7] ..... H04R 25/00

(52) U.S. Cl. ..... 381/382; 381/370; 381/375; 381/355

(58) Field of Search ..... 381/370, 371, 381/375, 376, 382, 338, 91, 122, 355, 356, 357, 358, 360, 361; 181/20, 21, 22, 128, 129; 379/430

(56) References Cited

U.S. PATENT DOCUMENTS 2,485,405 A * 10/1949 Olney et al. ..... 381/370
5,761,298 A 6/1998 Davis et al.

FOREIGN PATENT DOCUMENTS

DE 1098999 10/1959

* cited by examiner

*Primary Examiner*—Huyen Le
(74) *Attorney, Agent, or Firm*—Altera Law Group, LLC

(57) ABSTRACT

An acoustic transmission connection, e.g. for a headset (13), comprises a sound tube (2) through which speech signals can be transmitted from a first end (16) to a transducer, e.g. a microphone, in a housing or a housing part (3) of the headset. In the sound tube (2) and in the housing part (3), means are provided for acoustic impedance matching and possibly means for achieving acoustic directivity.

8 Claims, 13 Drawing Sheets

Figure 1:
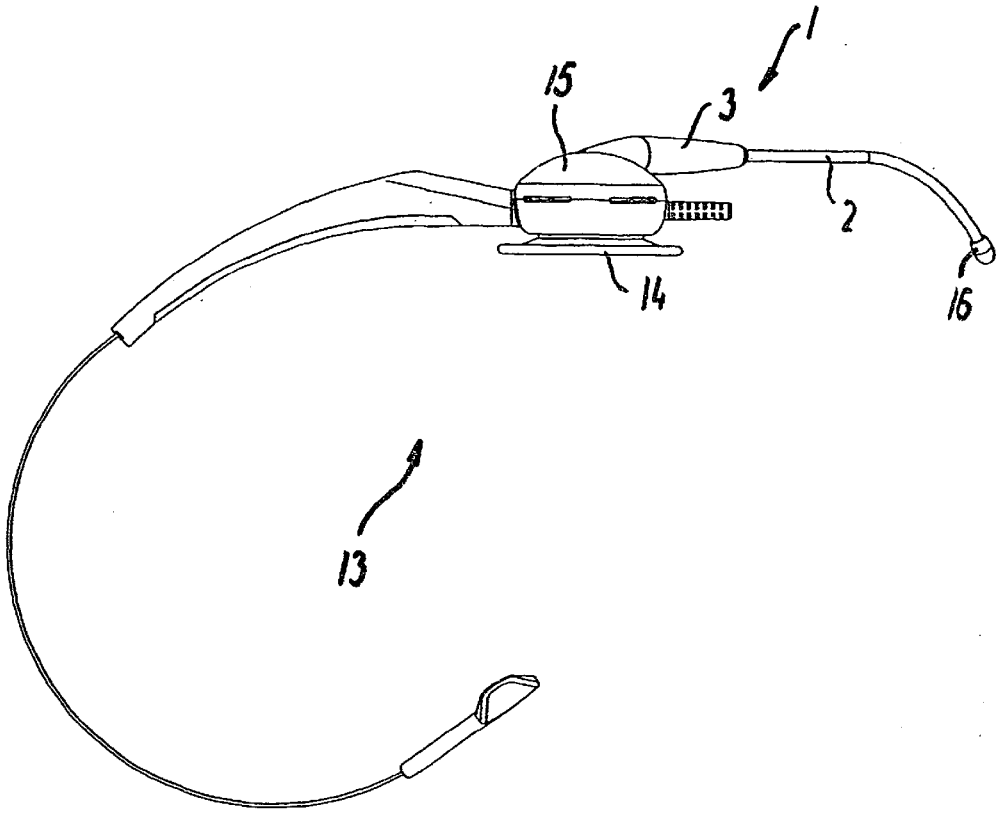

ACOUSTIC TRANSMISSION CONNECTION, HEADSET WITH ACOUSTIC TRANSMISSION CONNECTION, AND USES OF THE ACOUSTIC TRANSMISSION CONNECTION

The invention concerns an acoustic transmission connection which comprising a tubular element in which speech signals can be transmitted from a first end of the tubular element to a second end of the tubular element, and a transducer which is placed in the proximity of the second end of the tubular element, so that speech signals which are transmitted from the first end to the second end of the tubular element are converted to electrical signals by the transducer.

the transducer is placed in a housing in a first cavity which stands in connection with the second end of the tubular element via an acoustic channel, and that in connection with the said second end of the tubular element, means are configured for acoustic impedance matching of the transmitted signals, said means for acoustic impedance matching comprising a further acoustic channel, which from the said second end of the tubular element leads to a second cavity in the housing.

The invention also comprises a headset of the kind disclosed in the preamble to claim 5.

This is achieved by configuring the acoustic transmission connection as disclosed and characterised in claim 1, e.g. in connection with a headset as disclosed and characterised in claim 5. The possibility is hereby provided of effecting an acoustic adjustment, so that standing waves in the sound tube are avoided, and so that desired acoustic characteristics are obtained depending on the purpose for which the acoustic transmission connection is to be used. If a headset is involved, e.g. for telephonic use or the like, it is possible to achieve acoustic characteristics which can be converted to electrical signals which provide a particularly good telephone transmission quality.

Thus, in a simple manner the possibility is provided of realising desired acoustic characteristics in practice. This is effected in a way and with means, which, in a simple and herewith relatively cheap manner, can be manufactured and mass-produced. The simple construction also has the result that this can be a mechanically stable and durable construction, so that no changes arise in characteristics even after long-time use.

An expedient embodiment is disclosed in claim 2.

If the acoustic transmission connection according to the invention is configured as disclosed and characterised in claim 3, e.g. in connection with a headset as disclosed and characterised in claim 6, acoustic directivity is introduced, in that the sensitivity becomes direction dependent. This provides the possibility of adjusting the acoustic transmission connection more precisely for a given use. If it is to be used for a microphone, e.g. a headset, it is possible to achieve desired noise suppression, or it can be achieved that mainly only sound from certain directions is detected. Such acoustic qualities have very great practical significance. These characteristics and advantages can be improved further by configuring the transmission connection according to the invention as disclosed and characterised in claim 4, e.g. in connection with a headset as disclosed and characterised in claim 7 or 8.

As will also be seen from the explanation in the description, an acoustic transmission connection according to the invention has a great practical advantage when used as disclosed in more detail.

Figure 2:
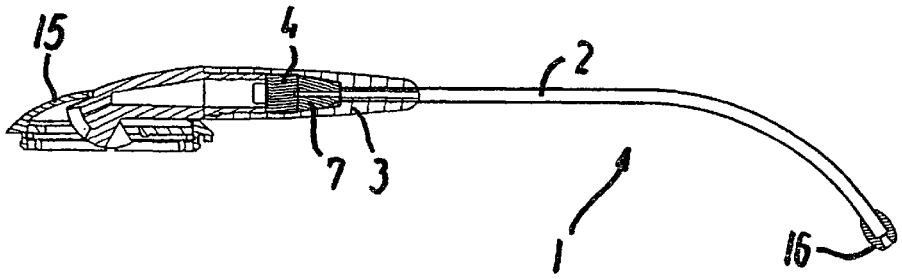
Figure 3:
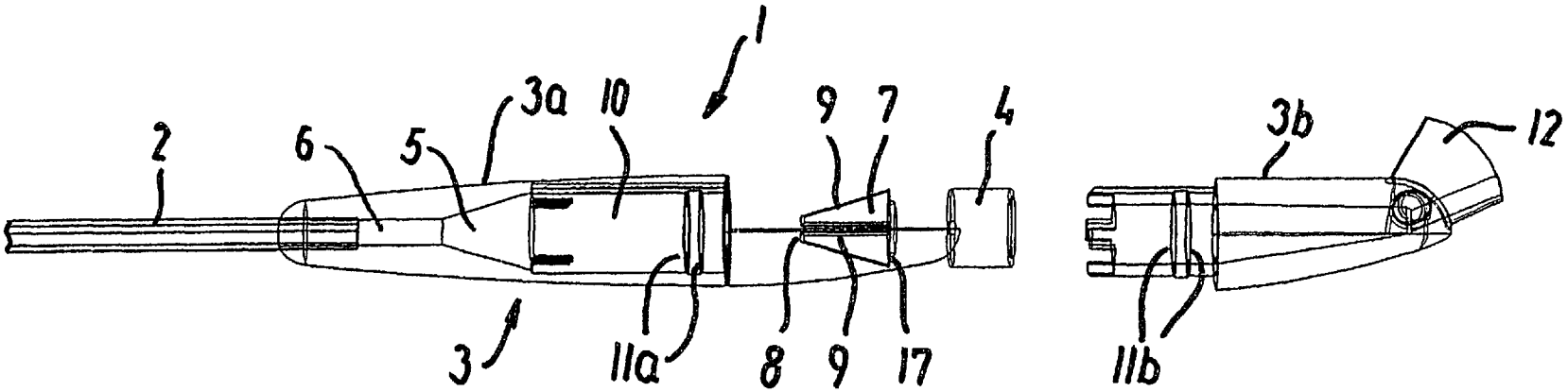
Figure 4:
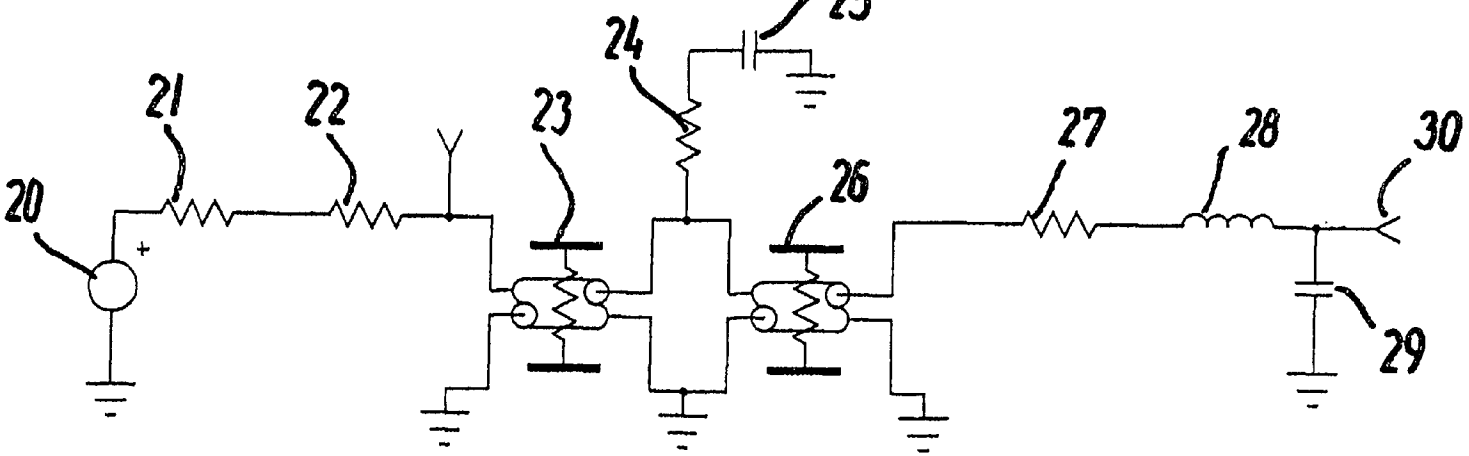
Figure 5:
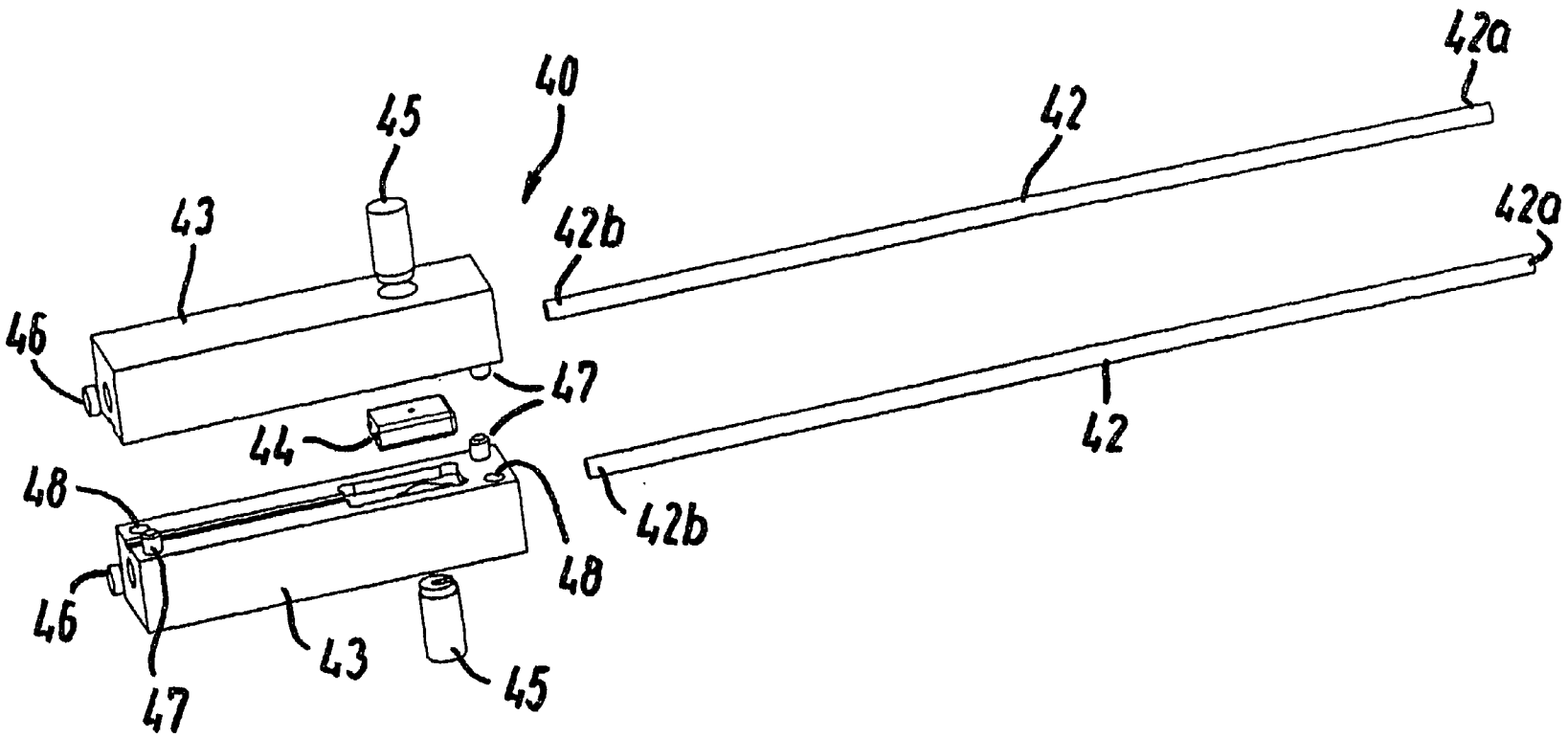
Figure 6:
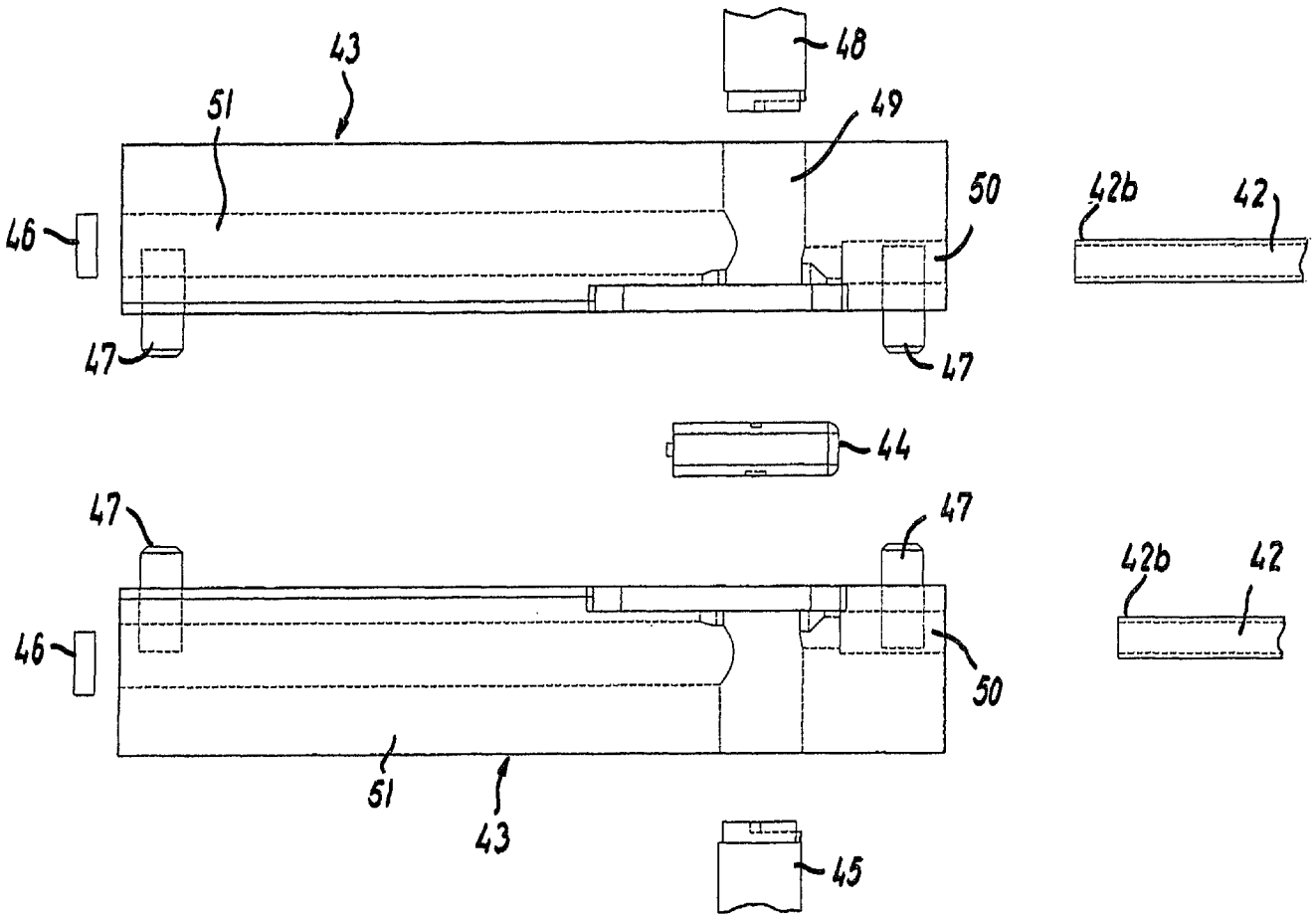
Figure 7:
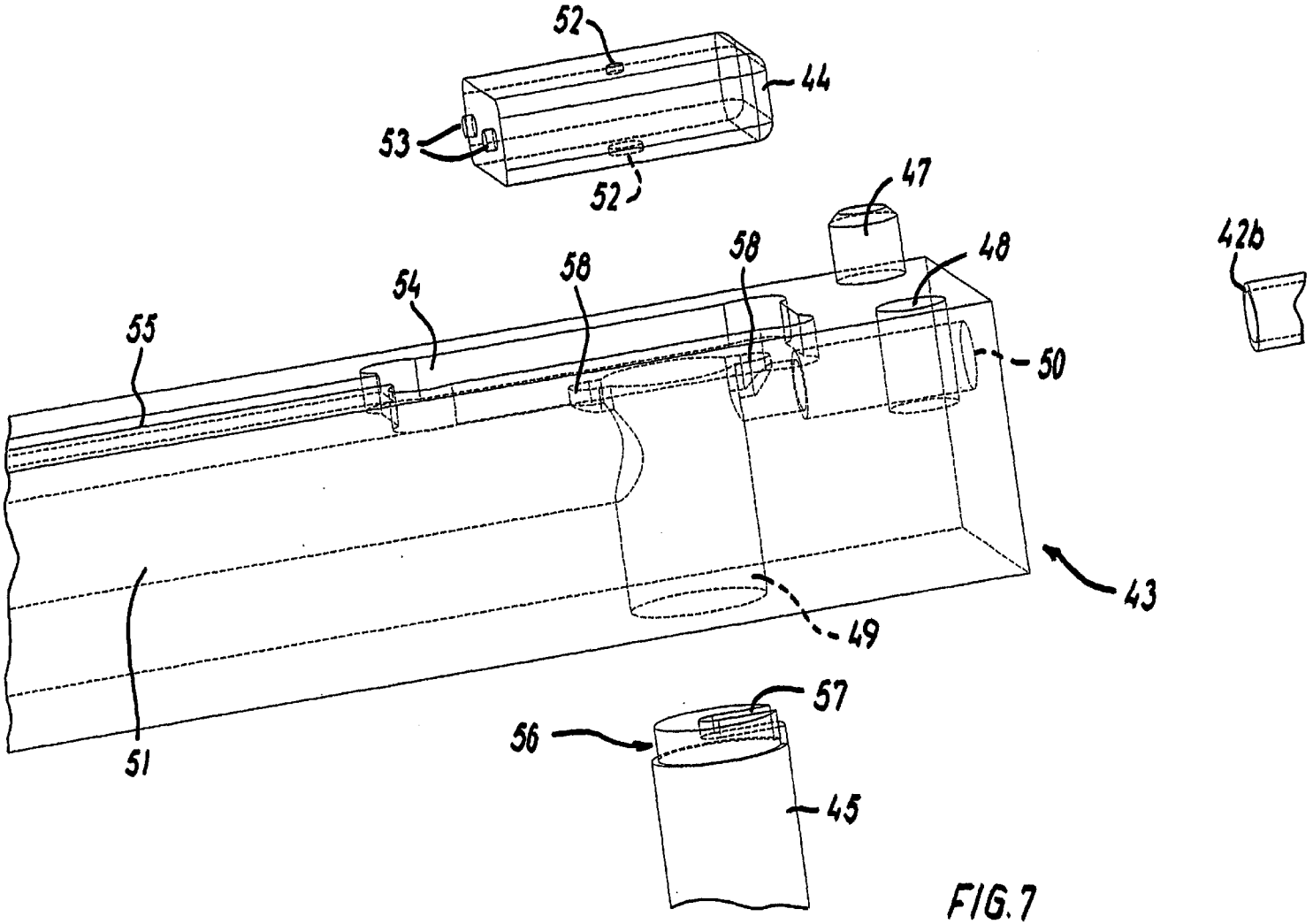
Figure 8:
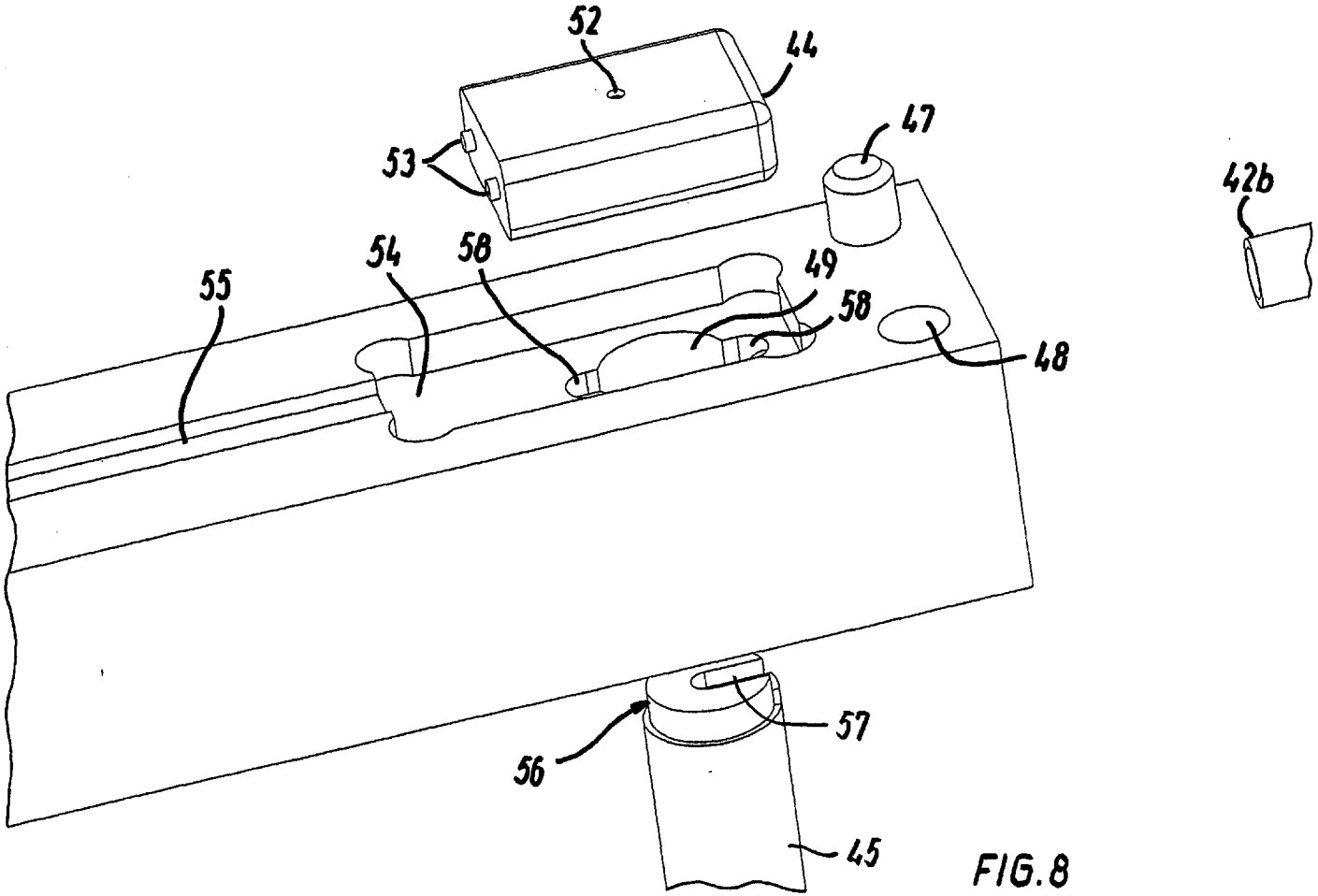
Figure 9:
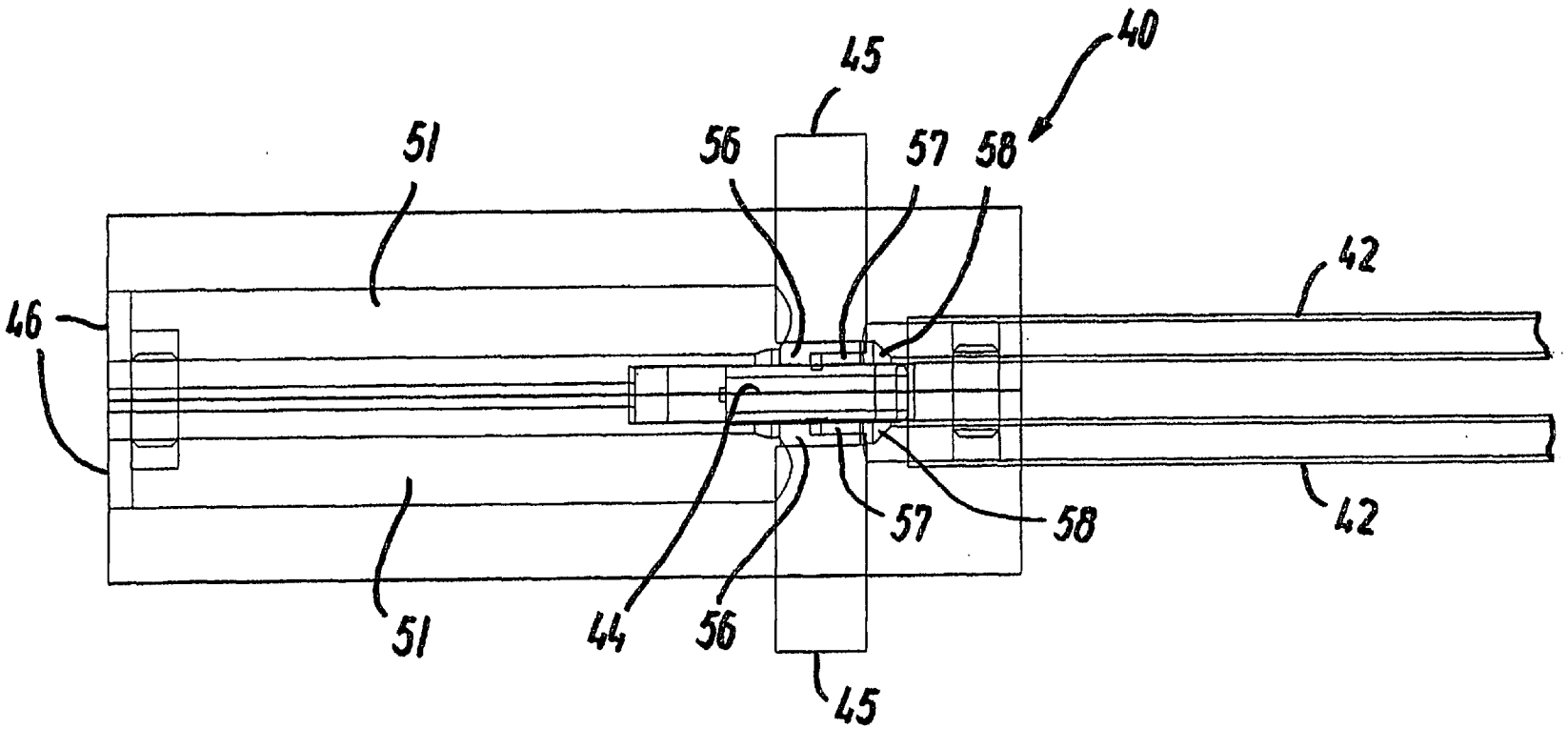
Figure 10:
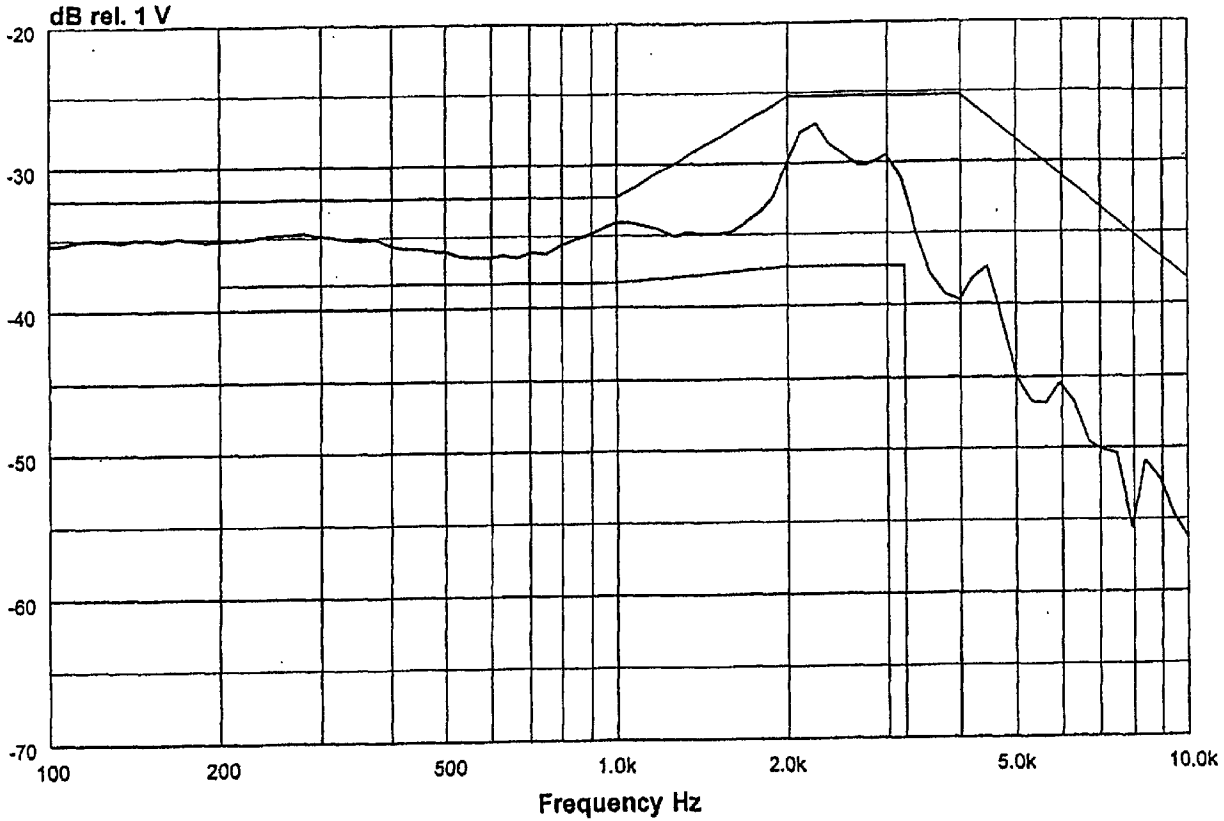
Figure 11:
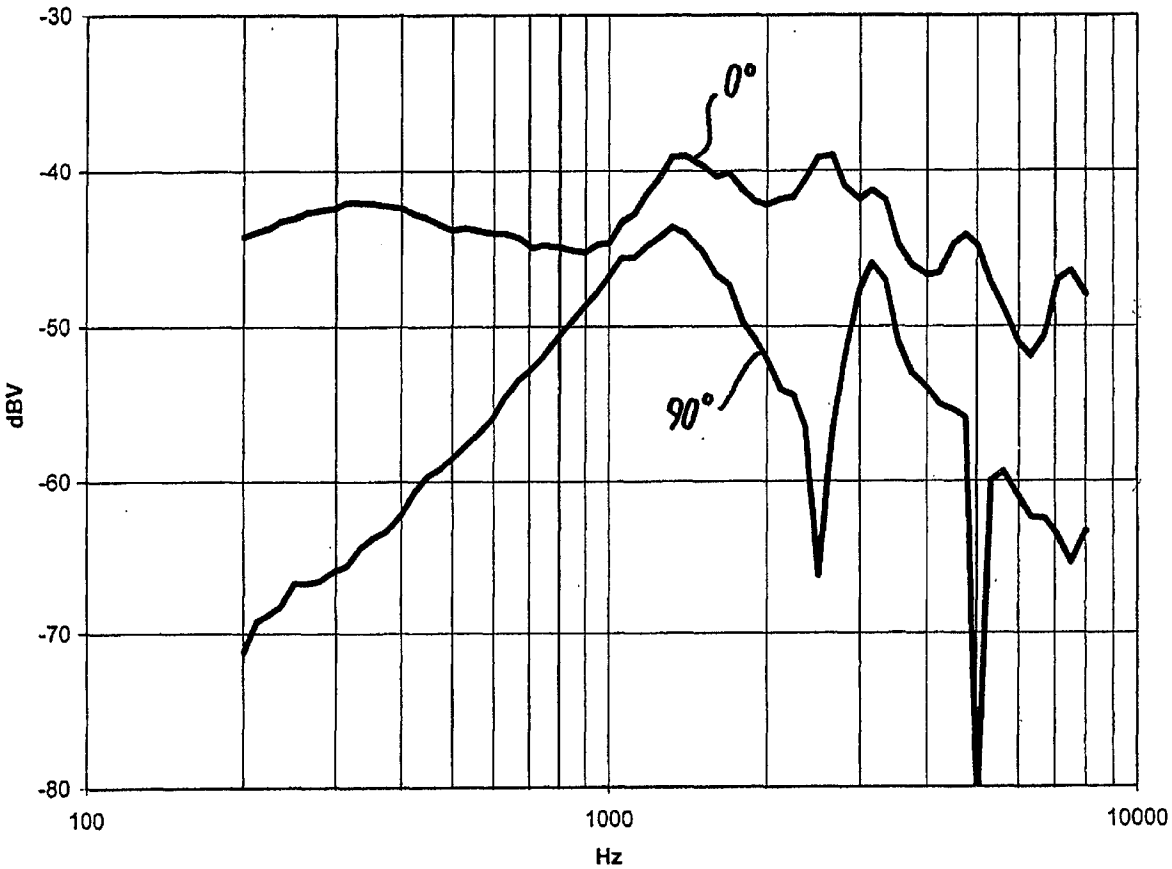
Figure 12:
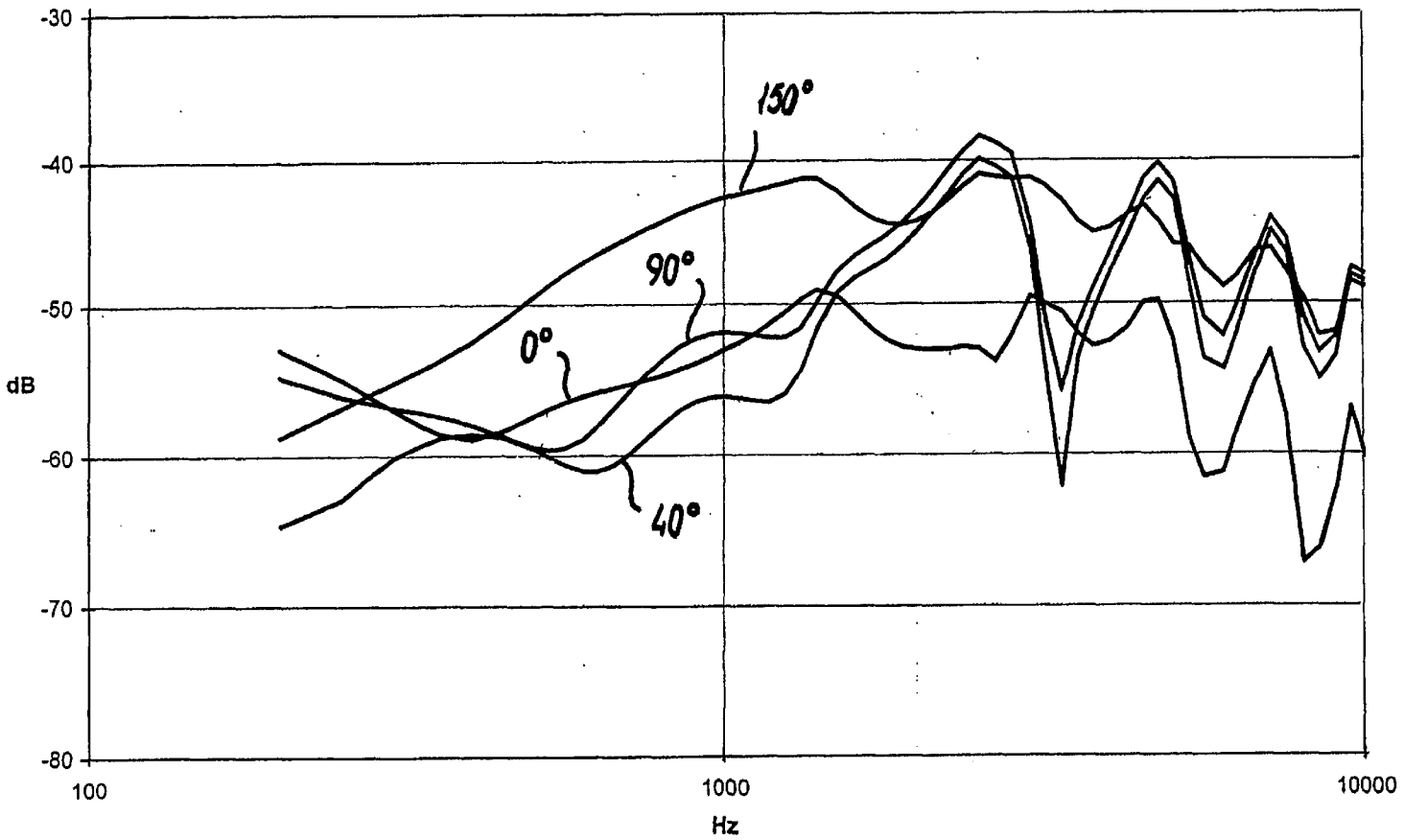
Figure 13:
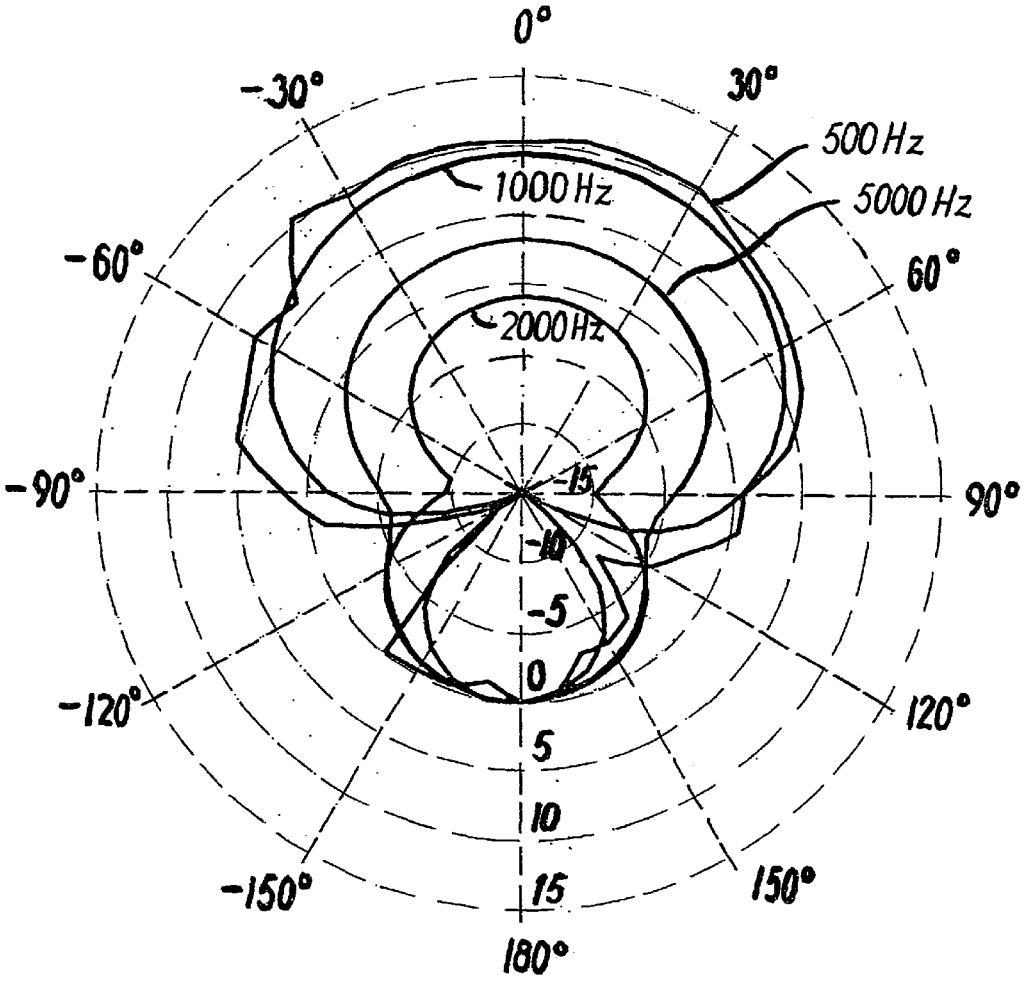
Figure 14:
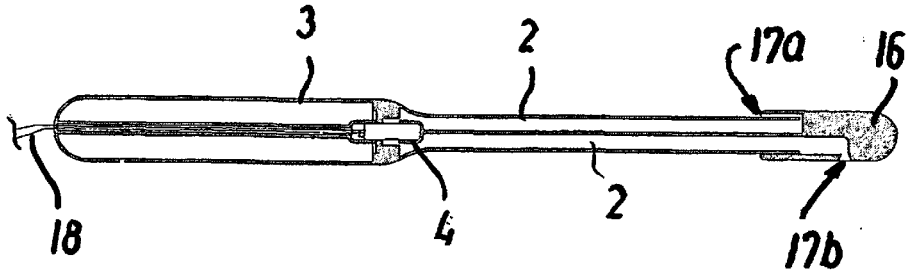

In the following, the invention will be explained in more detail with reference to the drawings, where FIG. 1 shows a headset with an acoustic transmission connection according to the invention, FIG. 2 shows on a larger scale a plane section in the microphone boom in the headset in FIG. 1, said boom comprising the acoustic transmission connection, FIG. 3 shows on an even larger scale and in partly separated form a first embodiment of an acoustic transmission connection according to the invention, FIG. 4 shows an electrical equivalent diagram, which corresponds to an acoustic transmission connection as shown in FIGS. 2 and 3, FIG. 5 shows in partly separated form a second embodiment of an acoustic transmission connection according to the invention, FIG. 6 shows a side view, on a larger scale, of the embodiment of the invention shown in FIG. 5, FIG. 7 shows parts of the embodiment shown in FIG. 3, seen in perspective and on an even larger scale, FIG. 8 shows the parts shown in FIG. 5, but in another perspective, FIG. 9 shows a side view of a longitudinal section through the embodiment shown in FIGS. 5–8, but in assembled state, FIG. 10 shows a frequency characteristic for an acoustic transmission connection according to the first embodiment of the invention, FIG. 11 shows frequency characteristics for an acoustic transmission connection according to the second embodiment of the invention, FIG. 12 similarly shows frequency characteristics for the second embodiment, FIG. 13 shows space characteristics for the second embodiment according to the invention, and FIG. 14 shows on another scale an embodiment of the invention comprising a microphone housing, two sound tubes and a termination part as one unit.

In FIG. 1 is seen an example of a complete headset 13 in which use can be made of the acoustic transmission connection 1 according to the invention. The transmission connection 1 comprises a tubular element 2 and a housing 3, which parts will be discussed in more detail later. Additionally, the headset has a housing part 15 which forms a mechanical transition between the microphone boom and the housing 14, in which is placed a transducer in the form of a telephone capsule or the like. The housing parts 14 and 15 can be turned in relation to each other.

In FIG. 2 a plane section through the microphone boom itself is seen, and in addition to what is seen in FIG. 1, a speaker or microphone 4 and an adjustment element 7 are shown, which form part of the acoustic transmission connection, and which therefore are discussed in more detail later. At the free end of the tubular element 2 a termination part 16 is seen, which constitutes the sound inlet, and which can possibly comprise an acoustic filter.

FIG. 3 shows the parts, which form a first embodiment 1 of an acoustic transmission connection according to the invention, which for example can be used in connection with a headset. 2 indicates the tubular element, which in the following is called the sound tube, and which serves to lead audio signals from its one end, which for example can be in the proximity of the user's mouth, to the other end, which is suspended in a housing 3.

This housing 3 consists of two half-parts 3*a* and 3*b*, and among other things serves to secure a transducer 4 for the conversion of speech signals to electrical signals. In the following, this transducer will also be referred to as the microphone. The sound tube 2 is secured in the one half-part 3*a* of the housing and stands in connection with a conical cavity 5 via a short tube connection 6. The conical cavity 5 is designed to accommodate a correspondingly conical element 7, which has a through-going acoustic channel 8, e.g. in the form of a hole extending substantially along its axis. The element 7 also has one or more additional acoustic channels 9, which can be configured as grooves or slots, which extend in the surface of the element 7 substantially in the longitudinal direction of the element. For example, the element 7 can be configured with four slots 9 which are displaced by 90° from one another along the surface of the element 7. As will be seen in FIG. 3, when the element 7 is placed in the cavity 5, the channel 8 will form a continuation of the connection from the sound tube 2, and the further acoustic channel(s) 9, which outwardly are closed by the inner surface of the cavity 5, will function as connection from the sound tube 2 and forward to the rear end and outer edge of the element 7. These acoustic channels 9 terminate in an annular area 17 along the end surface of the element 7 at that end which is arranged to face inwards towards the microphone 4. The channels 9 are connected to one another by the annular area.

When the element 7 is placed in the cavity 5, the microphone 4 can be placed in the space 10 in the half-part 3*a*. Between the element 7 and the microphone 4, two volumes are hereby formed, i.e. a volume opposite the acoustic channel 8, which serves to transfer speech signals to the transducer 4 itself, and a volume comprising the annular area 17 along the periphery of the transducer 4 and the element 7, which volume is connected to the acoustic channel(s) 9, in that this volume and the channels 9 serve as impedance matching for the whole of the acoustic system. This will be described in more detail later in connection with FIG. 4.

The housing half-part 3*a* is provided in the space 10 with internal locking elements 11*a*, which can co-operate with external locking elements 11*b* on the housing half-part 3*b*, so that the two half-parts are held together. The locking elements can, for example, be annular snap-lock parts. On the housing half-part 3*b* there is a connection part 12, which serves to connect the part 1, for example, to the remaining part of a headset. Finally, at the first end (not shown) of the sound tube 2, a resistive damping arrangement in the form of an acoustic filter can be provided, said arrangement consisting, for example, of damping material, steel wool or the like, which can serve as supplement to the built-in impedance matching which consists of the acoustic channel (s) 9 and the connected volume.

The sound tube 2 can be configured in a material, which allows the tube to be bent, especially so that the tube continues to assume the shape it is given. This is expedient in connection with a headset, for example, where the first end of the sound tube can be adjusted individually by the user and brought into the proximity of the mouth as required.

FIG. 4 shows the equivalent electrical diagram, which corresponds to the acoustic system, which is described above. Here, 20 indicates the generator, which corresponds to the sound source, which transmits sound through the air. The resistance of the air is indicated at 21, and the resistance of a possibly used resistive damping at the first end of the sound tube is indicated at 22. The sound tube 2 itself and the equivalent impedance of the short tube connection 6, which is resistive, are indicated at 23 and, as shown earlier, the sound tube is coupled to the acoustic channel 8, which has the equivalent resistance 26, and to the acoustic channel(s) 9 with the equivalent resistance 24, which in turn is coupled to an equivalent capacitance 25, corresponding to the terminating volume which comprises the annular area 17. From the equivalent resistance 26, the signal is coupled to a resistance 27 and an inductance 28, which represents the microphone 4, and a capacitance 29, which represents the space in which the microphone is placed. The resulting signal can thus be taken off at the node 30, and it is seen that by the calculation methods normally used in connection with electrical circuits, the values can be calculated for the resistance 24 and the capacitance 25 which will provide a suitably even transfer function for the acoustic circuit and forward until the electrical signal is taken off at 30. When the other values in the circuit are known, these values can be used in the dimensioning of the acoustic channel(s) 9 and the volume associated herewith, and/or an iterative calculation process can be carried out, in that other values forming part of the circuit can be changed, such as e.g. the resistance 26 corresponding to the acoustic channel 8.

FIGS. 5–9 show details of a second embodiment of the invention, where use is made of the same principle in the configuration of an acoustic transmission connection, but where two substantially identical transmission connections are coupled together in parallel, or substantially in parallel, in that a minor angular difference can be involved, whereby directivity for the connection can be obtained.

Such an acoustic transmission connection 40 is shown in FIG. 5, where the most important of the individual parts are shown separated from one another. As will be seen, the connection comprises two identical sound tubes 42, each with a first end 42*a* and a second end 42*b*. These sound tubes are each mounted in an end part of their separate housings 43, which also contain cavities, which can be. blocked off with plugs 45 in the sides and plugs 46 in the other end parts of the housings 43. The two housings can be joined together, in that between them they secure a transducer 44, and in that studs 47 and corresponding stud holes 48 are provided in the two surfaces, which are brought together for mutual positioning and securing. As will be seen, with the shown positioning of the studs 47 and stud holes 48, the two housings can be configured in an identical manner.

As will be seen in FIGS. 6 and 7, where FIG. 7 shows only the one housing 43 With associated parts, in the one end part of the housings 43 cylindrical openings or holes 50 are configured, which serve to accommodate the end parts 42*b* of the sound tubes 42. Moreover, cylindrical openings or holes 49 in which the plugs 45 are placed are configured from the side. Finally, from the other end parts of the housings 43 cylindrical openings or holes 51 are configured which, as shown, can be plugged with the plugs 46. As will be seen, the holes 50, 49 and 51 adjoin one another, so that there is free passage between the respective holes before the plugs 45 are placed in the holes 49.

In FIG. 7 and FIG. 8 it is shown how at the innermost end of each plug 45 an annular undercut or step or the like 56 is provided, which extends all the way around the end part of the plug. Moreover, from the one side a radial slot 57 is configured, which extends substantially in to the center axis of the plug 45.

It is also seen from FIGS. 7 and 8 that holes 52 are provided in each side of the transducer 44, in that these holes serve to lead speech signals in to the active part of the transducer part, e.g. a membrane or the like, and that the. transducer has terminals 53 for the electrical connection at its end. The transducer is received in recesses 54 in the housings 43, and in extension of these recesses there are channel-shaped recesses 55 for e.g. cable connections.

Finally, it is seen in FIGS. 7 and 8 that each side of the transverse hole 49 is configured with recesses 58, the function of which will be described in more detail in the following with reference to FIG. 9, which shows a longitudinal section of the assembled acoustic transmission connection.

When each sound tube 42 is placed with its second end part 42*b* in the corresponding bore 50, the speech signals can pass from each sound tube forward to the foremost recesses 58. From here, the speech signals can pass either via the radial slot 57 to the hole 52 in the transducer 44, which corresponds to the first acoustic channel 8 in the first embodiment according to the invention, or the speech signals can pass via the annular undercut 56 and rearwards to the cavity in the bore 51, which as mentioned is closed with the plug 46. This latter connection corresponds to the additional acoustic channel(s) 9 which are described in connection with the first embodiment of the invention. An acoustic system which is similar to that described in connection with the embodiment shown in FIG. 3 is hereby established, and thus an acoustic impedance matching can be established in the same manner as explained earlier, e.g. by dimensioning and configuration of the recesses 58, the slots 57 and the undercuts. 56 so that a desired frequency response is achieved.

With this embodiment, where two substantially identical transmission connections are coupled in parallel, a directional effect can also be achieved. In that the incoming speech signals will influence the same transducer, but from each their side, signals which arrive from the same direction will have a phase difference which is dependent on the angle which the incoming speech signals form with the axis of the sound tubes. 42. Speech signals which come in with the same direction as the axes of the sound tubes, when it is presupposed that the other or free ends 42*a* of the sound tubes end at the same place in the longitudinal direction, will reach forward to the transducer with the same phase, whereby the two speech signals which influence each their side of a membrane or corresponding, movable element in the transducer 44, will equalise each other. On the other hand, if an angular difference is involved, a phase difference will arise at the transducer depending on the size of the angular difference, so that the resulting electrical signal will be dependent on the direction of the received speech signals. If the free ends 42*b* of the sound tubes do not end at the same place in the longitudinal direction, this will naturally have an influence on which direction will now be that which provides an equalisation of the two incoming signals.

FIG. 10 shows the frequency characteristic for an acoustic transmission connection such as that e.g. described in connection with FIGS. 3 and 4, in that it has been recorded for a sound tube with an external diameter of 2.0 mm and an internal diameter of 0.7 mm. As will be seen, no significant resonance areas arise in the characteristic, which over a wide frequency range remains within an area of 5 dB. In FIG. 10 the limits for what can normally be considered as an acceptable frequency range for the recording of sound for ordinary communication, e.g. telephone communication, are also drawn. It is seen that the frequency characteristic remains entirely within these limits.

In FIGS. 11, 12 and 13 are shown space characteristics for a transmission connection of the kind, which is described in connection with FIGS. 5–9. FIG. 11 shows frequency characteristics for 0° and 90°, respectively, from which it is seen that there is a distinct difference in the levels for the received signals. The acoustic transmission connection is thus directionally dependent.

FIG. 12 correspondingly shows characteristics for an acoustic transmission connection where recordings for 0°, 40°, 90° and 150° have been made. Finally, FIG. 13 shows the spatial characteristic for the frequencies 500 Hz 1000 Hz, 2000 Hz and 3000 Hz. Also here a directional dependence is ascertained.

A transmission connection of the type described above in connection with FIGS. 5–9 can expediently be used in connection with a headset, in that the two tubes can thus be molded into a protective and positioning layer of e.g. plastic, or enclosed within a similar protective layer so that the sound tubes appear as a single element. The directivity will hereby result in the sound from a users mouth being predominant in relation to other sounds, such as noise from the surroundings, speech from other persons etc. A significant improvement in the comprehensibility and clarity of the recorded sound is hereby achieved.

FIG. 14 shows a section through a microphone arm corresponding to that shown in FIG. 2, but configured as a one-piece unit, e.g. injection moulded in plastic. The unit comprises the microphone housing 3 with microphone 4 and wires 18 hereto, two sound tubes 2 and a terminating part 16, so that two sound inlet openings 17*a* and 17*b* are provided, one for each sound tube 2.

This configuration, which is shown only in a principle drawing, shows a practical embodiment for a unit which can be arranged for coupling together with e.g. a telephone housing 14 as in FIG. 1 for the formation of a headset. The detailed configuration of the microphone housing 3 is not shown in FIG. 14, but the housing 3 can be configured so that it can be coupled in a simple manner with e.g. a headband and a telephone housing for a headset, which can be adjusted individually by the user.

Furthermore, the described embodiments of the invention can be used in other connections, where speech signals are to be registered or transmitted in a place to which accessibility can possibly be difficult, and where the transducer itself is placed at a certain distance from the place where the speech signals are registered or recorded. For example, this can be the case in connection with hearing aids and in connection with probe microphones. Probe microphones are used, for example, to register speech signals in a person's ear, e.g. in the auditory canal, which is of significance in the adjustment of hearing aids where it is desired to register those signals which are actually transmitted further into the user's ear.

Moreover, the acoustic transmission connection can be used in connection with microphone arrays which are configured with regard to a certain directional characteristic, e.g. a very narrow directional characteristic which, for example, is desirable in connection with microphones for use at conferences, the use of PCs etc., where it is only the speech signals from a single person among many which are desired to be detected by the microphone. For such a use, the embodiment which is described in connection with FIGS. 5–9 will be expedient, in that the directional characteristic of this in connection with the configuration of the microphone in an array will prove further directional determination when the received signals are summated, such as is known from microphone arrays, possibly combined with electrical signal processing of the received signals for amplification of the directivity, such as is also commonly known in connection with microphone arrays.

What is claimed is:

1. Acoustic transmission connection, comprising:

A tubular element in which speech signals can be transmitted from a first end of the first tubular element to a second end of the first tubular element; and a transducer which is placed in the proximity of the second end of the first tubular element, so that speech signals which are transmitted from the first end to the second end of the first tubular element are converted to electrical signals by the transducer, and where the transducer is placed in a housing in a first cavity which stands in connection with the second end of the first tubular element via a first acoustic channel, and that in connection with the said second end of the first tubular element, means are configured for acoustic impedance matching of the transmitted signals, said means for acoustic impedance matching comprising a second acoustic channel, which from the said second end of the first tubular element leads to a second cavity in the housing, wherein in the housing an insertable element is configured in which the first acoustic channel and the second acoustic channel are formed, and that this insertable element is placed between the transducer and the second end of the first tubular element.

2. Acoustic transmission connection according to claim 1, wherein the second acoustic channel comprises two or more part-channels, each of which leads from the second end of the first tubular element to the second cavity.

3. Acoustic transmission connection according to claim 1, wherein the connection comprises a second tubular element which is placed extending in substantially the same direction as the first tubular element, in that the second tubular element similarly has a first and a second end, where the second end stands in connection with the transducer in the housing.

4. Acoustic transmission connection according to claim 3, wherein the second end of the second tubular element is similarly connected to the means for acoustic impedance matching, said means comprising an acoustic channel which leads from the second end of the second tubular element to a third cavity in the housing.

5. Headset, comprising:

a transducer for conversion of speech signals to electrical signals, which transducer is placed in an encapsulation;

and a first tubular element which has a first end and a second end, where the first end is arranged to receive speech signals, mainly from a user's mouth, where the second end stands in connection with the transducer, and where the speech signals are transmitted via the first tubular element to the transducer, and where the transducer is placed in the encapsulation in a first cavity which stands in connection with the second end of the first tubular element via a first acoustic channel, and that in connection with the said second end of the first tubular element, means are configured for acoustic impedance matching of the transmitted signals, said means for acoustic impedance matching comprising a second acoustic channel, which from the said second end of the first tubular element leads to a second cavity in the encapsulation, wherein in the encapsulation an insertable element is configured in which the first acoustic channel and the second acoustic channel are formed, and that this insertable element is placed between the transducer and the second end of the first tubular element.

6. Headset according to claim 5, wherein the second acoustic channel comprises two or more part-channels, each of which leads from the second end of the first tubular element to the second cavity.

7. Headset according to claim 5, wherein the connection comprises a second tubular element which is placed extending substantially in the same direction as the first tubular element, in that the second tubular element similarly has a first and a second end, where the second end stands in connection with the transducer in the encapsulation.

8. Headset according to claim 7, wherein the second end of the second tubular element is similarly connected to the means for acoustic impedance matching, said means comprising an acoustic channel which leads from the second end of the second tubular element to a third cavity in the encapsulation.

* * * * *